US006374442B1

(12) United States Patent
Wells

(10) Patent No.: US 6,374,442 B1
(45) Date of Patent: Apr. 23, 2002

(54) POCKETED COIL SPRING UNIT WITH COMBINATION OF TOP AND BOTTOM SHEETS AND INTER-ROW BONDING

(75) Inventor: Thomas J. Wells, Carthage, MO (US)

(73) Assignee: L&P Property Management Co., Southgate, CA (US)

( * ) Notice: Subject to any disclaimer, the term of this patent is extended or adjusted under 35 U.S.C. 154(b) by 0 days.

(21) Appl. No.: 09/493,380

(22) Filed: Jan. 28, 2000

(51) Int. Cl.[7] ..... A47C 27/06
(52) U.S. Cl. ..... 5/720; 5/655.8
(58) Field of Search ..... 5/720, 727, 655.8

(56) References Cited

U.S. PATENT DOCUMENTS

| | | | | |
|---|---|---|---|---|
| 1,434,653 A | | 11/1922 | Fiss et al. | |
| 2,296,807 A | | 9/1942 | Cavaler | |
| 2,862,214 A | | 12/1958 | Thompson et al. | |
| 3,429,767 A | | 2/1969 | Bronstein, Jr. et al. | |
| 3,449,190 A | | 6/1969 | Bronstein, Jr. et al. | |
| 4,234,983 A | | 11/1980 | Stumpf | 5/270 |
| 4,401,501 A | | 8/1983 | Stumpf | |
| 4,485,506 A | | 12/1984 | Stumpf et al. | |
| 4,566,926 A | | 1/1986 | Stumpf | |
| 4,578,834 A | | 4/1986 | Stumpf | |
| 4,907,309 A | | 3/1990 | Breckle | |
| 5,016,304 A | | 5/1991 | Ryhiner | |
| 5,016,305 A | | 5/1991 | Suenens et al. | |
| 5,126,004 A | | 6/1992 | Suenens et al. | |
| 5,273,608 A | | 12/1993 | Nath | |
| 5,319,815 A | | 6/1994 | Stumpf et al. | |
| 5,637,178 A | | 6/1997 | Suenens et al. | |
| 5,670,001 A | | 9/1997 | Huebner et al. | |
| 5,746,877 A | | 5/1998 | Notheis et al. | |
| 5,851,339 A | | 12/1998 | Rucker | |
| 6,098,968 A | * | 8/2000 | Workman | 5/655.8 |
| 6,175,997 B1 | | 1/2001 | Mossbeck | |
| 6,243,900 B1 | * | 6/2001 | Gladney et al. | 5/720 |

FOREIGN PATENT DOCUMENTS

| | | | | |
|---|---|---|---|---|
| DE | 4031652 | | 4/1992 | |
| DE | 4040220 | | 6/1992 | |
| EP | 0089789 | | 9/1983 | |
| EP | 0357912 | | 3/1990 | |
| FR | 1475098 | | 2/1967 | |
| FR | 2076465 | | 10/1971 | |
| FR | 2470088 | | 5/1981 | |
| GB | 743678 | * | 6/1920 | 5/720 |

* cited by examiner

*Primary Examiner*—Matthew C. Graham
(74) *Attorney, Agent, or Firm*—Wood, Herron & Evans, LLP

(57) ABSTRACT

A pocketed coil spring unit and associated method of assembly combines top and bottom sheets with bonding of the sidewalls of adjacent rows of pocketed coil springs. With this combination, a posturized spring unit is produced in a commercially efficient manufacturing process. The top and bottom sheets extend perpendicularly to the rows of pocketed coil springs and the adjacent rows of pocketed coil springs are bonded on the sidewalls of the fabric pockets in the absence of the top and bottom sheets. As such, the spring unit can be customized for posturization to provide a firmer supporting foundation at the locations of the top and bottom sheets and a more individualized flexible construction in the regions of the inter-row sidewall bonding.

27 Claims, 2 Drawing Sheets

POCKETED COIL SPRING UNIT WITH COMBINATION OF TOP AND BOTTOM SHEETS AND INTER-ROW BONDING

BACKGROUND OF THE INVENTION

This invention relates generally to spring units for use in mattresses, spring upholstered furniture and the like and, more particularly, to an improved pocketed coil spring unit and associated method of manufacturing such a spring unit.

A well known type of spring assembly includes a number of discrete coil springs, each of which is enclosed in a fabric pocket in a length of folded fabric material. Longitudinal axes of the coil springs are generally parallel with one another so that the top and bottom end turns of the coil springs define top and bottom faces of the spring unit. A spring assembly can be fabricated from such a spring unit by forming rows of the pocketed coil springs and binding or adhering the individual rows together to form a mattress or spring assembly.

This type of spring assembly is commonly referred to as a pocketed spring unit due to the fact that each spring is contained within an individual pocket of fabric material. The construction of strings of pocketed coil springs in each pocket is well known in the art and, for example, disclosed in U.S. Pat. No. 4,439,977 which is hereby incorporated by reference in its entirety. The system disclosed in that patent includes a spring coiler which forms a coil spring which is subsequently compressed and inserted between the plies of folded pocketing fabric material. Other systems for manufacturing pocketed coil spring assemblies are disclosed in PCT patent application Ser. No. WO94/18116 and U.S. patent application Ser. No. 08/927,051 filed Sep. 10, 1997, each of which are expressly incorporated herein by reference.

Pocketed spring units are generally recognized to have a unique and particular luxurious feel to them and mattresses manufactured of such pocketed spring units provide a feeling of softness without lacking spring resilience or support. Mattresses and similar articles constructed of pocketed spring units are often considered a high-end type of product because of the added benefits and features of the pocketed coil springs. Mattresses and the like of this type can be more costly to manufacture and assemble as a result of the considerable amount of time and labor which is involved in their manufacture, together with the fact that the method of fabrication and assembly of such pocketed spring units can be complicated, particularly in an automated process.

One particular aspect of the commercial production of pocketed spring units and the associated mattresses or the like is the handling of such units in the factories. The manipulation and movement of the various components of the spring unit from station to station or various areas of the factories can be cumbersome, difficult and inconvenient depending on the particular production facilities and assembly techniques.

Additionally, while pocketed spring units are considered to provide a combination of softness and support, the ability to economically posturize a spring unit or mattress of pocketed spring coils has heretofore been unavailable. Posturization provides zones of support within a mattress. For example, the middle regions of the mattress, which typically support a person's torso, often require a firmer more resilient support while other areas of the mattress which support the feet and head of a person require a softer feel.

Therefore, there is a need for an improved pocketed spring unit and associated method of manufacture which offers the advantages of posturization of the spring unit without the higher manufacturing costs, production difficulties and inefficiencies associated with known spring units.

SUMMARY OF THE INVENTION

These and other objectives of the invention have been obtained in an improved pocketed coil spring unit and associated method of manufacturing such a spring unit according to this invention. In one embodiment, the pocketed coil spring unit of this invention and associated method combines top and bottom sheets with side gluing or bonding of the rows of pocketed coil springs. By using this combination, a posturized spring unit is produced in a commercially effective manufacturing process.

The pocketed coil spring unit includes narrow strips of non-woven material extending generally perpendicular to the rows of pocketed coil springs. Supply rolls of the non-woven sheets are positioned on the top and bottom of the coil unit being assembled. Strings or rows of pocketed coil springs are serially added to the forming coil unit which is positioned between top and bottom conveyors. Adhesive is applied to the top and bottom sheets to adhere the sheets to the top or bottom surface of the pocketed coil springs as the rows are added to the forming coil spring unit. The strips of top and bottom sheets are positioned as required on the coil spring unit and, in one embodiment, just one sheet in the center of the spring unit on the top and bottom faces is utilized to provide posturization of the spring unit, mattress or the like. The top and bottom sheets are applied to the top and bottom, respectively, of the coil spring unit at locations where a firmer, more resilient support foundation is desired. On the remaining sections of the coil spring unit, side gluing or bonding of the adjacent rows or strings of pocketed coil springs is utilized to provide the flexible benefits of such a construction. Specifically, in one embodiment, the sidewalls of the pocketed coil springs are sprayed with adhesive or otherwise bonded to the sidewalls of pocketed coil spring units in adjacent rows. Known spring units which are side glued or bonded to the adjacent rows of coil spring units typically do not have the top and bottom sheets bonded thereto.

One advantage of this invention is the ability to efficiently and conveniently handle the coil spring unit in the factories in that it will act like a top/bottom glued construction while still providing the flexible benefits of a side glued unit. Moreover, this invention offers the ability to customize or posturize the spring unit with various zones of resiliency and support. As such, this invention provides increased benefits during the manufacturing of pocketed coil spring units while offering advantages, including posturization, not currently available in known pocketed coil spring units, mattresses or the like.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
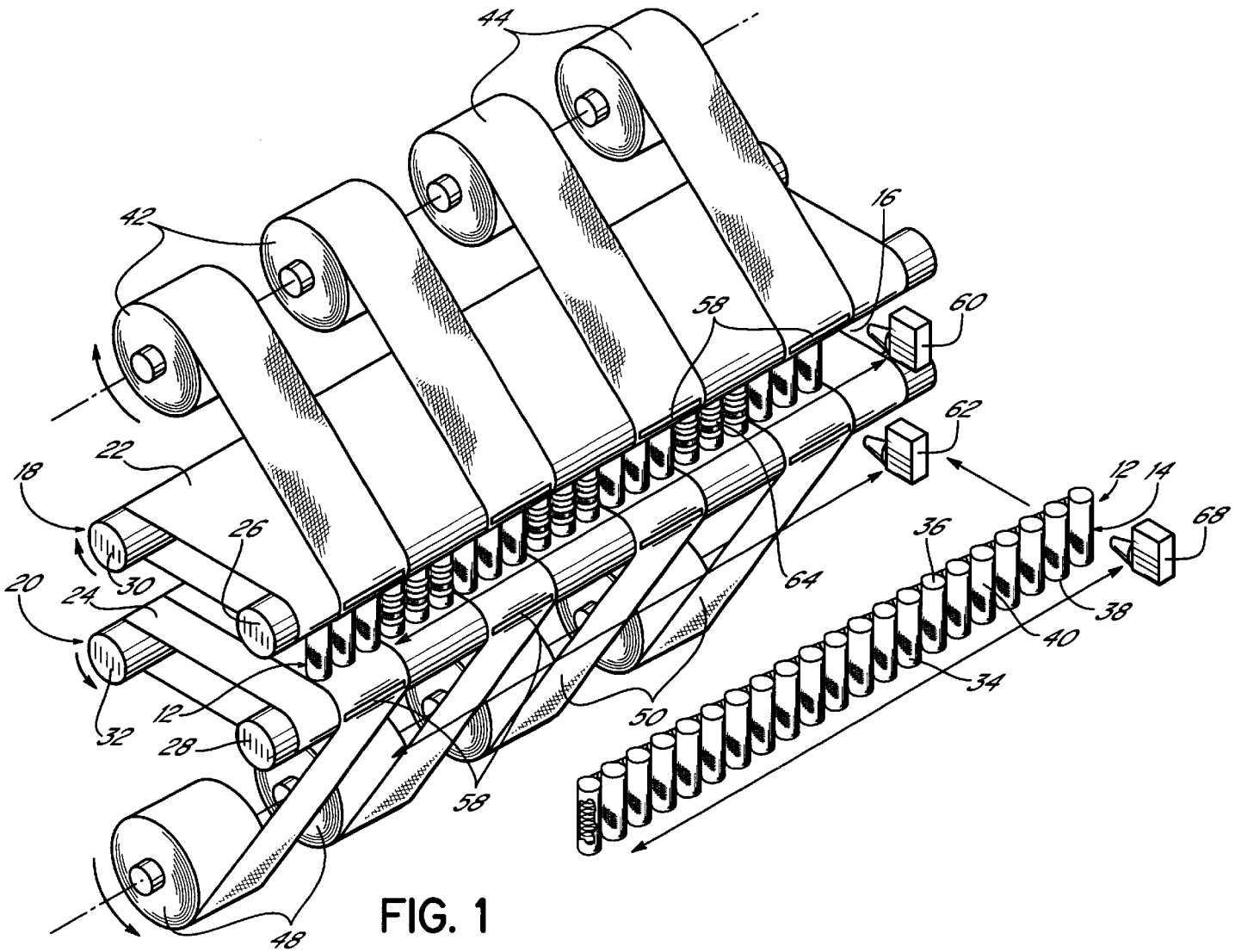
FIG. 1 is a perspective view of a pocketed spring unit being assembled between top and bottom conveyors according to one embodiment of this invention.
Figure 2:
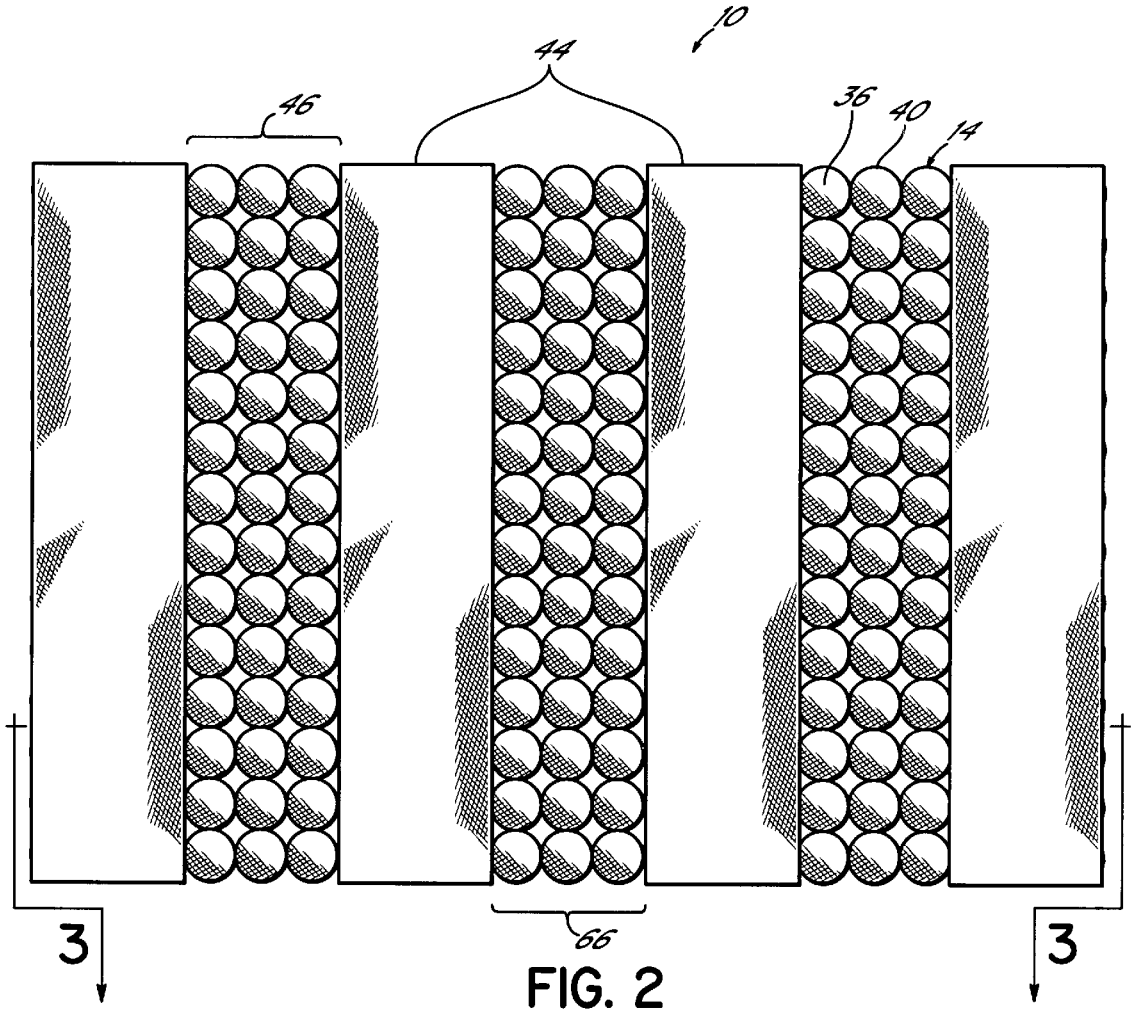
FIG. 2 is a top plan view of a spring unit according to one embodiment of this invention.
Figure 3:
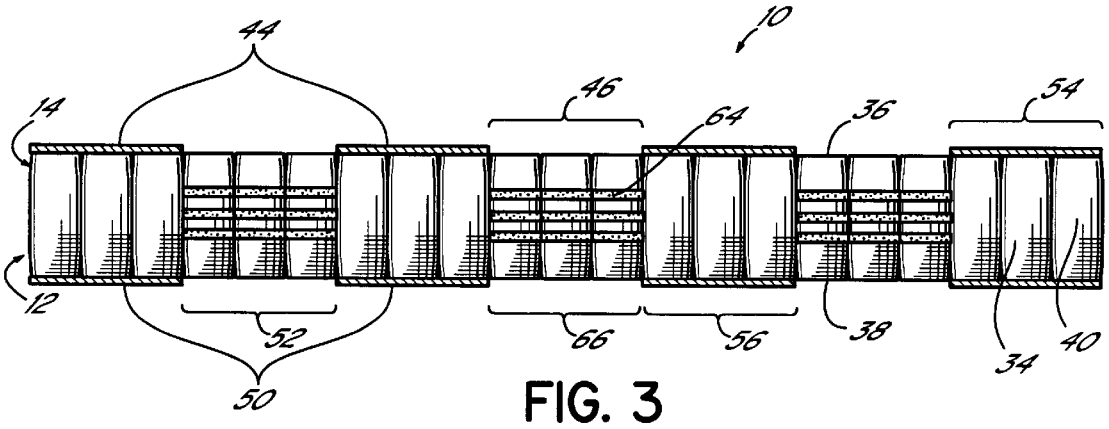
FIG. 3 is a cross-sectional view taken along line 3—3 of the spring unit of FIG. 2.

Referring to FIG. 1, one embodiment of a system and method for manufacturing a pocketed coil spring unit 10 (as shown in FIGS. 2 and 3) is shown. Particularly, individual rows 12 of pocketed coil springs 14 are serially introduced into the gap 16 between an upper conveyor 18 and a lower conveyor 20. Each of the conveyors 18, 20 includes a belt 22, 24 trained around a forward roller 26, 28 and a trailing roller 30, 32, at least one of which is rotationally driven for movement of the belt 22, 24 as shown in FIG. 1.

Each row 12 of pocketed coil springs includes a number of coil springs 14 encased in a fabric pocket 34 having a top end 36, a bottom end 38 and a sidewall 40 extending between the top and bottom ends 36, 38 of each pocket 34. Commonly, each row 12 of pocketed coil springs 14 is manufactured as a continuous string as is well known in the art. An example of the manufacture of a string of pocketed coil springs is disclosed in U.S. Pat. No. 4,439,977. The fabric in one embodiment of this invention is a nonwoven material which is thermally or ultrasonically weldable to itself as is well known in the art.

A number of supply rolls 42, four of which are shown in FIG. 1, feed preferably nonwoven material, similar to that used to encase the coil springs 14, as top sheets 44 on the top of the spring unit 10. Each of the top sheets 44 are separated from the adjacent top sheet by a spacing 46. Similarly, a number of supply rolls 48 are located below the lower conveyor 20 to feed nonwoven or other sheet material as bottom sheets 50 located on the bottom of the spring unit 10. The bottom sheets 50 are also each separated by a spacing 52 from the adjacent bottom sheet 50. Although four top sheets 44 and four bottom sheets 50 are shown in FIG. 1, it should be readily understood that any number of top and bottom sheets can be used within the scope of this invention. The top and bottom sheets 44, 50 extend generally perpendicular to the rows 12 of pocketed coil springs 14 and, in one embodiment, the top and bottom sheets 44, 50 are aligned generally vertically with respect to each other.

The top sheets 44 are each bonded to the top ends 36 of each of a first set 54 of pocketed coil springs 14. Similarly, the bottom sheets 50 are each bonded to the bottom ends 38 of each of a second set 56 of pocketed coil springs 14. In the embodiment shown in the Figures, the coil springs 14 of the first set 54 and second set 56 are the same springs.

The top and bottom sheets 44, 50 are each bonded to the respective top and bottom ends 36, 38 of the fabric pockets 34 of the coil springs 14 by an adhesive 58 which has been sprayed onto the top and bottom sheets 44, 58 from respective upper and lower adhesive applicators 60, 62, as shown in FIG. 1. However, it should be readily understood that the term "bonding" as used herein applies to other means of attachment for the sheets 44, 50 to the rows 12 of pocketed coil springs 14, such as thermally activated adhesive embedded in the sheets and/or the fabric pockets, stitching, mechanical fasteners such as lacing wire, clips, clamps or other techniques.

Adhesive 64 is also applied to the sidewall 40 of the fabric pockets 34 of a third set 66 of pocketed coil springs 14 from an adhesive applicator 68. In the embodiment shown in FIG. 1, the fabric pockets 34 of the coil springs 14 to which the adhesive 64 is applied on the sidewalls 40 are those coil springs which do not have the top or bottom sheets 44, 50 bonded thereto. As a result, the posturization of the resulting spring unit 10 is achieved through differing performance characteristics of the sections of the spring unit 10 to which the top and bottom sheets 44, 50 are bonded relative to the sections which have inter-row bonding. In the embodiment shown in FIG. 1, the adhesive 64 is sprayed onto the sidewalls 40 of the appropriate fabric pockets 66 prior to the row 12 being introduced between the upper and lower conveyors 18, 20. Once again, although an adhesive spray applicator 68 is shown, other techniques, as previously mentioned, for bonding the sidewall 40 of the fabric pockets 34 of selected pocketed coil springs in the adjacent rows can be utilized within the scope of this invention.

Referring to FIGS. 2 and 3, the resulting spring unit 10 is shown in which the top and bottom sheets 44, 50 are bonded to the top and bottom ends 36, 38, respectively, of the fabric pockets 34of specific pocketed coil springs 54, 56. In the embodiment shown in FIGS. 2 and 3, four top and four bottom sheets 44, 50 are utilized and each of the top and bottom sheets 44, 50 are separated a spacing 46, 52 of three pocketed coil springs 14 from the adjacent sheet. This arrangement is used for illustration purposes only and other spacings 46, 52 can be utilized as desired within the scope of this invention. Additionally, the springs 66 positioned in the spacings 46, 52 between the respective top and bottom sheets have the adhesive 64 applied to the sidewalls 40 of the fabric pockets 34 for bonding of the adjacent rows 12 together. The adhesive pattern on the sidewalls 40 of those fabric pockets 34 may be straight lines extending across multiple fabric pockets 14 or another pattern that is appropriate for the desired spring unit 10.

As a result, a pocketed spring unit 10 is easily and efficiently manufactured in a commercial production manner which performs like a top/bottom glued spring unit construction for easier handling in the factories while still offering the flexible benefits, including posturization, of a side glued spring unit.

From the above disclosure of the general principles of the present invention and the preceding detailed description of at least one preferred embodiment, those skilled in the art will readily comprehend the various modifications to which this invention is susceptible. Therefore, I desire to be limited only by the scope of the following claims and equivalents thereof.

I claim:

1. A spring unit comprising:

a plurality of rows of pocketed coil springs, each row including a plurality of coil springs each encased in a fabric pocket, each fabric pocket having a top end, a bottom end and a sidewall between the top and bottom ends;

at least one top sheet extending across a first set of pocketed coil springs, the top sheet being bonded to the top ends of the fabric pockets of the first set; and at least one bottom sheet extending across the first set of pocketed coil springs, the bottom sheet being bonded to the bottom ends of the fabric pockets of the first set;

wherein the sidewalls of the fabric pockets of another set of pocketed coil springs are bonded to the fabric pocket sidewalls of corresponding pocketed coil springs in an adjacent row of pocketed coil springs.

2. The spring unit of claim 1 wherein the top and bottom sheets are oriented generally perpendicular to the rows of pocketed coil springs.

3. The spring unit of claim 1 wherein the top and bottom sheets are aligned with one another and bonded to the same pocketed coil springs.

4. The spring unit of claim 1 further comprising a plurality of top sheets each separated by a spacing from one another and a plurality of bottom sheets each aligned with one of the top sheets.

5. The spring unit of claim 1 wherein the another set of pocketed coil springs which are bonded along the fabric pocket sidewalls thereof to adjacent fabric pockets have neither the top nor bottom sheets bonded thereto.

6. The spring unit of claim 1 wherein the top and bottom sheets extend entirely across the spring unit.

7. A spring unit comprising:

a plurality of rows of pocketed coil springs, each row including a plurality of coil springs each encased in a fabric pocket, each fabric pocket having a top end, a bottom end and a sidewall between the top and bottom ends;

a plurality of top sheets extending across selected pocketed coil springs and generally perpendicular to the rows of pocketed coil springs, each top sheet being separated by a spacing from an adjacent top sheet and being bonded to the top ends of the fabric pockets of the selected pocketed coil springs; and a plurality of bottom sheets extending across the selected pocketed coil springs and generally perpendicular to the rows of pocketed coil springs, each bottom sheet being aligned with one of the top sheets and being bonded to the bottom ends of the fabric pockets of the selected pocketed coil springs;

wherein the sidewalls of the fabric pockets of the pocketed coil springs located in each spacing between adjacent top sheets are bonded to the fabric pocket sidewalls of corresponding pocketed coil springs in an adjacent row of pocketed coil springs to provide differing performance characteristics to the pocketed coil springs located in the spacings relative the selected pocketed springs.

8. A spring unit made by the method comprising the steps of:

arranging a plurality of rows of pocketed coil springs, each row including a plurality of coil springs each encased in a fabric pocket, each fabric pocket having a top end, a bottom end and a sidewall between the top and bottom ends, the sidewalls of the fabric pockets of each row of pocketed coil springs being juxtaposed to the sidewalls of the fabric pockets of an adjacent row with the top and bottom ends of the fabric pockets combining to define top and bottom surfaces, respectively, of the spring unit;

bonding a top sheet to the top ends of the fabric pockets of a first set of pocketed coil springs;

bonding a bottom sheet to the bottom ends of the fabric pockets of the first set of pocketed coil springs;

bonding the sidewalls of the fabric pockets of another set of pocketed coil springs to the sidewalls of the fabric pockets of pocketed coil springs in an adjacent row.

9. The spring unit of claim 8 further comprising:

bonding a plurality of top sheets to the top ends of the first set of pocketed coil springs;

spacing each of the top sheets from an adjacent top sheet;

bonding a plurality of bottom sheets to the bottom ends of the first set of pocketed coil springs;

spacing each of the bottom sheets from an adjacent bottom sheet; and orienting the top and bottom sheets generally perpendicular to the rows of pocketed coil springs.

10. The spring unit of claim 9 wherein the top and bottom sheets are aligned and bonded to the same coil springs and the top and bottom ends of the another set of pocketed coil springs are not bonded to the top and bottom sheets, respectively.

11. A spring unit comprising:

a plurality of rows of pocketed coil springs, each row including a plurality of coil springs each encased in a fabric pocket, each fabric pocket having a top end, a bottom end and a sidewall between the top and bottom ends;

a top sheet extending across a first set of pocketed coil springs;

first means for bonding the top sheet to the top ends of the fabric pockets of the first set;

a bottom sheet extending across a second set of pocketed coil springs;

second means for bonding the bottom sheet to the bottom ends of the fabric pockets of the second set; and third means for bonding the sidewalls of the fabric pockets of a third set of pocketed coil springs to the fabric pocket sidewalls of pocketed coil springs in an adjacent row of pocketed coil springs.

12. A spring unit comprising:

a plurality of rows of pocketed coil springs, each row including a plurality of coil springs each encased in a fabric pocket, each fabric pocket having spaced ends and a sidewall between the spaced ends;

at least one sheet extending across a first set of pocketed coil springs, the sheet being bonded to at least one end of each of the fabric pockets of the first set; and wherein the sidewalls of the fabric pockets of another set of pocketed coil springs are bonded to the fabric pocket sidewalls of pocketed coil springs in an adjacent row of pocketed coil springs;

wherein the fabric pockets of the another set are not bonded to the at least one sheet.

13. The spring unit of claim 12 wherein the ends of the first set of pocketed coil springs that are bonded to the at least one sheet are on a common face of the spring unit.

14. A spring unit comprising:

a plurality of rows of pocketed coil springs, each row including a plurality of coil springs each encased in a fabric pocket, each fabric pocket having spaced ends and a sidewall between the spaced ends; at least one sheet extending across a first set of pocketed coil springs, the sheet being bonded to at least one end of each of the fabric pockets of the first set; and wherein the sidewalls of the fabric pockets of another set of pocketed coil springs are bonded to the fabric pocket sidewalls of pocketed coil springs in an adjacent row of pocketed coil springs;

wherein the first set of pocketed coil springs are distinct from the another set of pocketed coil springs.

15. A spring unit comprising:

a plurality of rows of pocketed coil springs, each row including a plurality of coil springs each encased in a fabric pocket, each fabric pocket having a top end, a bottom end and a sidewall between the top and bottom ends;

top sheet means for covering the top ends of each of the pocketed coil springs in a first set;

first bonding means for bonding the top sheet means to the top ends of the fabric pockets of the first set;

bottom sheet means for covering the bottom ends of each of the pocketed coil springs in the first set;

second bonding means for bonding the bottom sheet means to the bottom ends of the fabric pockets of the first set; and third means for bonding the sidewalls of the fabric pockets of another set of pocketed coil springs to the fabric pocket sidewalls of pocketed coil springs in an adjacent row of pocketed coil springs.

16. A spring unit comprising:

a plurality of rows of pocketed coil springs, each row including a plurality of coil springs each encased in a fabric pocket, each fabric pocket having a top end, a bottom end and a sidewall between the top and bottom ends;

at least one top sheet extending across a first set of pocketed coil springs, the top sheet being bonded to the top ends of the fabric pockets of the first set; and at least one bottom sheet extending across the first set of pocketed coil springs, the bottom sheet being bonded to the bottom ends of the fabric pockets of the first set;

wherein another set of pocketed coil springs have neither the top nor bottom sheets bonded thereto.

17. The spring unit of claim 16 wherein the top and bottom sheets are oriented generally perpendicular to the rows of pocketed coil springs.

18. The spring unit of claim 16 wherein the top and bottom sheets are aligned with one another and bonded to the same pocketed coil springs.

19. The spring unit of claim 16 further comprising a plurality of top sheets each separated by a spacing from one another and a plurality of bottom sheets each aligned with one of the top sheets.

20. The spring unit of claim 16 wherein the top and bottom sheets extend entirely across the spring unit.

21. The spring unit of claim 16 wherein the pocketed coil springs in each row are interconnected to each other.

22. A spring unit comprising:

a plurality of rows of pocketed coil springs, each row including a plurality of coil springs each encased in a fabric pocket, each fabric pocket having a top end, a bottom end and a sidewall between the top and bottom ends;

are, a plurality of top sheets extending across selected pocketed coil springs and generally perpendicular to the rows of pocketed coil springs, each top sheet being separated by a spacing from an adjacent top sheet and being bonded to the top ends of the fabric pockets of the selected pocketed coil springs; and a plurality of bottom sheets extending across the selected pocketed coil springs and generally perpendicular to the rows of pocketed coil springs, each bottom sheet being aligned with one of the top sheets and being bonded to the bottom ends of the fabric pockets of the selected pocketed coil springs;

wherein a third set of pocketed coil springs have neither the top nor bottom sheets bonded thereto to provide differing performance characteristics to the pocketed coil springs in the third set relative the first and second sets.

23. A spring unit comprising:

a plurality of rows of pocketed coil springs, each row including a plurality of coil springs each encased in a fabric pocket, each fabric pocket having spaced ends and a sidewall between the spaced ends;

at least one sheet extending across a first set of pocketed coil springs, the at least one sheet being bonded to at least one end of each of the fabric pockets of the first set; and another set of pocketed coil springs that do not have the at least one sheet bonded thereto.

24. The spring unit of claim 23 wherein the at least one sheet is bonded to a top end of each of the pocketed coil springs in the first set, the spring unit further comprising:

a second sheet extending across the first set of pocketed coil springs and being bonded to a bottom end of each of the pocketed coil springs in the first set.

25. The spring unit of claim 24 further comprising:

a plurality of the second sheets; and a plurality of the at least one sheet;

wherein each of the sheets on the top and bottom ends of the pocketed coil springs are spaced from an adjacent sheet on the respective top and bottom ends of the pocketed coil springs.

26. The spring unit of claim 23 wherein the pocketed coil springs in each row are interconnected to each other.

27. The spring unit of claim 23 wherein the at least one sheet extends perpendicularly to the rows of pocketed coil springs.

* * * * *

UNITED STATES PATENT AND TRADEMARK OFFICE

CERTIFICATE OF CORRECTION

PATENT NO. : 6,374,442 B1
DATED : April 23, 2002
INVENTOR(S) : Thomas J. Wells

It is certified that error appears in the above-identified patent and that said Letters Patent is hereby corrected as shown below:

Column 7,
Line 40, please delete the phrase "are,".

Signed and Sealed this

Twenty-fourth Day of September, 2002

*Attest:*

*Attesting Officer*

JAMES E. ROGAN
*Director of the United States Patent and Trademark Office*